United States Patent [19]

Cullen et al.

[11] Patent Number: 4,687,244

[45] Date of Patent: Aug. 18, 1987

[54] LIFT AND REORIENTING MECHANISM

[75] Inventors: Paul R. Cullen, Minneapolis; Peter J. Schroeder, Plymouth, both of Minn.

[73] Assignee: Tilt-Lock, Inc., Hamel, Minn.

[21] Appl. No.: 778,231

[22] Filed: Sep. 20, 1985

[51] Int. Cl.[4] ..... B66C 1/54

[52] U.S. Cl. ..... 294/86.41; 294/93; 414/684; 414/911

[58] Field of Search ..... 294/67.2, 67.5, 86.25, 294/86.41, 89, 93–95, 97, 103.2; 414/620, 622, 626, 684, 783, 911

[56] References Cited

U.S. PATENT DOCUMENTS

| | | | |
|---|---|---|---|
| 3,423,120 | 1/1969 | Dalglish | 294/97 |
| 3,771,666 | 11/1973 | Fournier | 294/103.2 X |
| 4,154,470 | 5/1979 | Dalglish | 294/93 |
| 4,358,143 | 11/1982 | Cullen | 294/93 X |
| 4,430,040 | 2/1984 | Halmos | 294/67.5 X |
| 4,557,515 | 12/1985 | Read | 294/86.41 X |

FOREIGN PATENT DOCUMENTS

| | | | |
|---|---|---|---|
| 685790 | 1/1953 | United Kingdom | 294/95 |

*Primary Examiner*—Johnny D. Cherry

*Attorney, Agent, or Firm*—Lawrence M. Nawrocki

[57] ABSTRACT

A lift and reorienting apparatus is the subject of this document. The apparatus includes a probe (16) for insertion into an internal accessible axially extending opening (36) of an object to be moved. The probe (16) is pivotably carried by a frame (10) and maneuvered through the action of telescoping arms (46) of a dual arm actuator (42). This dual arm actuator (42) adds strength to the apparatus. The probe (16) is attached to the object to be lifted and reoriented by means of a retractable projection (18) and sleeve mechanism (24).

13 Claims, 2 Drawing Figures

LIFT AND REORIENTING MECHANISM

TECHNICAL FIELD

This invention is related broadly to the field of mechanical engineering and particularly to lifting mechanisms. More narrowly, the invention is directly related to apparatus for lifting and reorienting an object having an internally accessible axial opening.

BACKGROUND OF THE INVENTION

Various products are made and stored on rolls, reels, spools, etc. The weight and size or these products can make them unmanageable. Illustrative of such products are rolls of sheet metal, wire, newsprint and bales of hay. A number of apparatus, many with a central probe device, have been made to maneuver these awkward-/heavy products. This central probe device allows the lifting and reorienting of, in effect, anything with a central aperture; further examples being well casings and pipe tubing.

One such prior art structure uses a vacuum center lift device to hold the material onto the hollow center core by withdrawing air from between layers of sheet material.

Another prior art structure uses an expandible probe which is inserted into the hollow center of the roll, or reel or the like, thereby retaining the product on the probe.

A third prior art structure uses a lifting device wherein a probe is inserted into the hollow center core of the product in question. This probe uses a sleeve and tooth device whereby teeth from the probe are available to project into the center core of the product upon movement of the sleeve. This sleeve movement allows the teeth to pop up from the probe device and bite into the product core to retain the product on the probe. This prior art structure additionally uses a single actuator arm mechanism for pivoting the probe to maneuver the product when the probe is received in its hollow core.

A problem encountered with the retention of the product on the probe has been the canting of the sleeve device relative to the probe resulting in axial locking of the sleeve. A bias against the teeth causing the teeth to become held firmly in either the up or down position regardless of the intention of the operator can, thereby, result.

Another problem encountered with the retention function has been overmovement of the sleeve apparatus relative to the probe allowing the probe teeth to withdraw too far within the probe. Consequently, the teeth projections are left without means to effect their extension. Further sleeve manipulation no longer results in activation of the teeth to the outward position.

A problem encountered with the lifting and maneuvering of the product derives from the often significant weights thereof. The weight of the product is often too great for the power of the lifting device.

The present invention provides apparatus to overcome these difficulties.

SUMMARY OF THE INVENTION

The present invention is a lift and reorienting apparatus for maneuvering objects having an internal axial opening and includes a framework with which other components are associated. The invention includes a probe apparatus which is capable of being pivoted and which has means for attachment to objects to be lifted and reoriented by the apparatus. The attachment means takes the form of one or more retractable projections that radially extend from the probe. These projections may consist of tooth-like mechanisms. A sleeve, circling the probe and having access ports for receipt of the toothlike mechanisms, moves axially along the probe providing the means for the extension of the tooth-like mechanisms to their first, extended position. A coaxial spring mechanism, encircling the probe and abutting the sleeve, urges the sleeve to this first position.

Means are provided for the retraction of these projections by urging the sleeve axially along the probe to the second positon. This means can include structure for exerting axial force upon the sleeve mechanism. This force application causes the projections extending from the probe to be retracted within the probe commensurately with the sleeve movement to the second position.

Extending radially from the probe can be an appendage which cooperates with the sleeve mechanism to limit relative axial movement thereof. This appendage can protrude through an elongated slot formed in the sleeve and engage ends of the slot to control the movement of the sleeve mechanism.

The probe apparatus is able to be pivoted by action of a dual arm telescoping actuator. This actuator effectuates this pivoting motion by means of retracting or extending its dual telescoping legs. This dual arm actuator is attached, at a first end, to the frame, and at the other end to a linkage arm pivotably mounted to the frame at the probe end thereof. The linkage arm rigidly carries the probe so that, as the arm is pivoted, so is the probe.

Operation of the dual arm actuator in being extended or retracted is directly related to movement of the probe. This enables the probe to be maneuvered to positions for picking up and reorienting products by being inserted within the central hollow core thereof.

The present invention is thus an improved apparatus for lifting and reorienting objects. Additional features of the invention and advantages obtained in view of those features will become more apparent with reference to the DETAILED DESCRIPTION OF THE INVENTION, appended claims, and accompanying drawing figures.

DETAILED DESCRIPTION OF THE INVENTION

Figure 1:
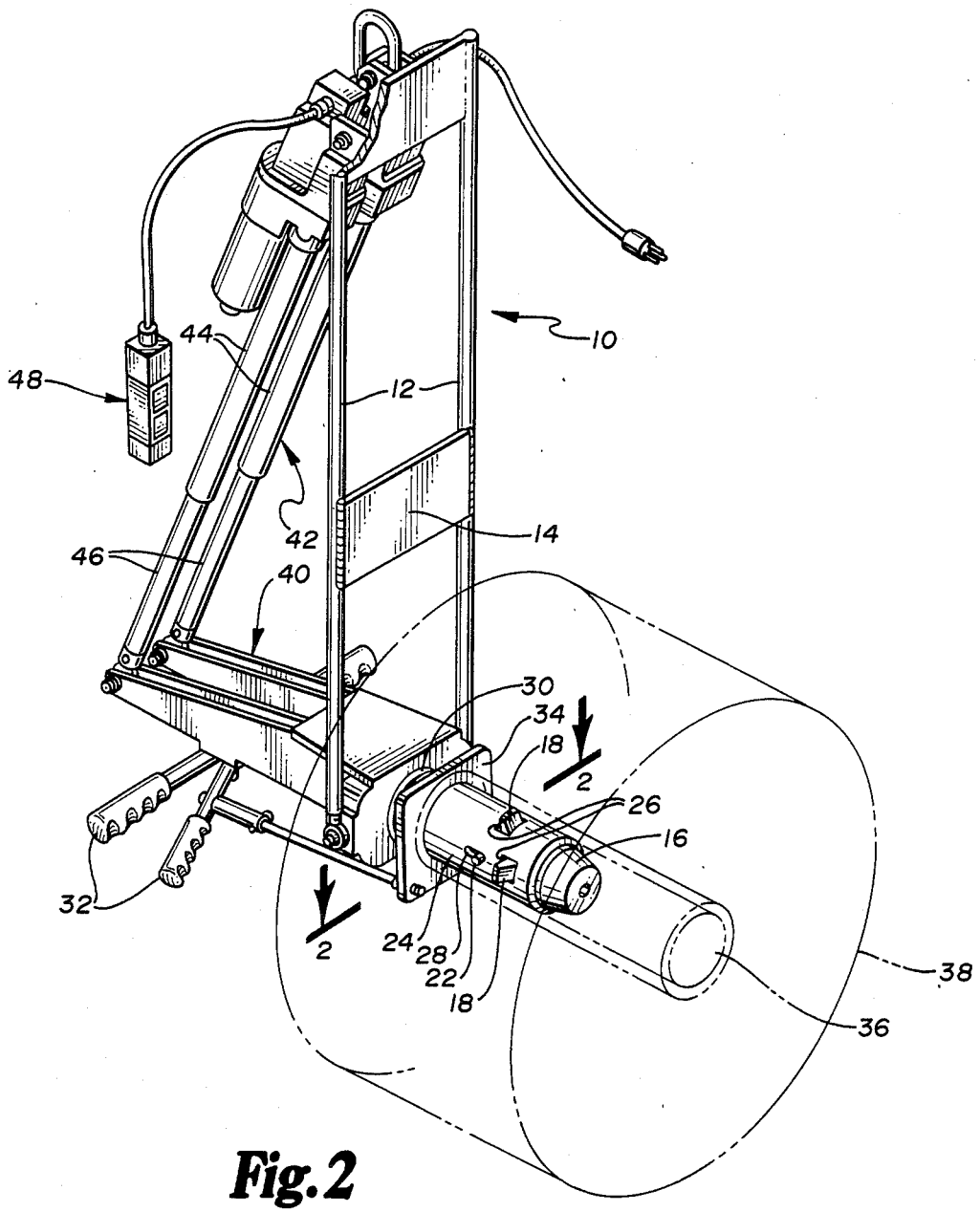
FIG. 1 is a perspective view of a lift and reorienting mechanism in accordance with the present invention.

Referring now to the drawing wherein like reference numerals denote like elements throughout the several views, FIG. 1 illustrates in perspective a lifting and reorienting apparatus embodying the invention of the present application. As seen in that figure, a frame 10, comprising two elongated members 12, with a crossing panel piece 14, is suspended in a generally vertical orientation and carries the other portions of this apparatus.

A probe 16 is pivotably carried by the frame. This probe 16 is elongated and carries one or more retractable projections 18. These projections 18 retract when pressure is applied to one side of the projection, and retraction can further be facilitated by spring biasing means 20 shown in detail in FIG. 2.

The probe 16 also carries a radially extending appendage 22 that is rigidly fixed thereto. Both the retractable projection 18 and the rigidly fixed appendage 22 project radially from the probe 16 through a sleeve mechanism 24 that encircles the probe 16. This sleeve mechanism 24 is disposed for reciprocation axially along said probe 16. The sleeve 24 interacts with both the retractable projections 18 and the rigidly fixed appendage 22.

Interaction between the sleeve 24 and the retractable projections 18 allows for the projections 18 to be in their first extended position when the sleeve 24 is in its first position. Recesses 26 in the sleeve 24 accommodate the retractable projections 18 in their extended positions when the sleeve 24 is in the first position. When the sleeve 24 is urged to its second position, axial motion of the sleeve 24 causes an axial end of the recess to urge the retractable projection 18 to retract within the probe 16.

Figure 2:
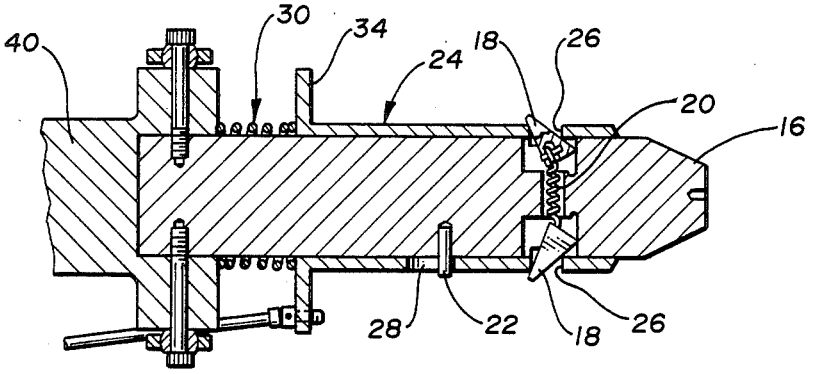
FIG. 2 is an enlarged view taken generally along the line 2—2 of FIG. 1.

A spring mechanism 30, shown in FIG. 2, coaxial with the sleeve 24 and also encircling the probe 16, urges the sleeve 24 to a first position facilitating extension of the retractable projections 18. Interaction between the coaxial spring mechanism 30 and the sleeve 24 edge, because the spring 30 encircles the probe 16, results in force being applied equally circumferentially to the edge of the sleeve 24 and thus prevents canting of the sleeve 24 against the retractable projections 18. The sleeve mechanism 24 is urged to its second position by force applied against this coaxial spring mechanism 30.

In the drawing the force application mechanism is illustrated as an attachment between a pair of gripping handles 32 and a sleeve shoulder plate 34. While this is shown as stated, forced application can be accomplished by a number of means.

The sleeve mechanism 24 moves axially along the probe 16 a distance allowed by the rigidly extended appendage 22. This rigidly extended appendage 22 protrudes from its fixed attachment location on the probe 16 through an elongated slot 28 in the sleeve 24. This axially extended slot 28 receives the rigidly extended appendage 22 and acts as a limited length track along which the appendage rides.

The probe 16 functions to attach to an internal accessible axially extending opening 36 in the object 38 to be lifted and reoriented, shown in phantom. The size of the sleeve 24 coincides with this axially extended opening 36.

The drawing illustrates the probe 16 attachment at one end of the frame 10, however, other positions of attachment would also work. The specific structure of the probe mechanism 16 is shown in greater detail in FIG. 2 and discussed hereinafter. The probe 16, while pivotably attached to the frame 10, is rigidly carried by a linkage arm 40 at one end thereof. Pivoting of the probe 16 is effectuated by pivotably mounting the linkage arm 40 to the frame 10. This arm 40 connects the probe 16 and the dual arm actuator apparatus 42.

The dual arm actuator 44 pivotably fixed at its upper end to the frame 10 allows the probe 16 to be positioned in either a substantially horizontal position, a substantially vertical position, and any position in between. The dual arm actuator 44 allows for this positioning of the probe 16 through the telescoping of the arms 46 thereof. Retraction of the dual arm actuator telescoping arms 46 causes a shortening of the distance between the upper end of the frame 10 and the end of the linkage arm 40 connected to the actuator 42. Shortening of this distance, in turn, causes the rigidly fixed probe 16 to become positioned in a more vertical position.

Extension of the dual arms 46 of the actuator 42 results in the opposite effect. Extension of these dual arms 46 causes the linkage arm 40 to be pushed down away from the top of the frame 10, thereby causing the rigidly fixed probe 16 to come to a more horizontal position.

Controlling the movement of the dual arm actuator 42 results in maneuverability of the probe 16 allowing the operator to insert the probe 16 into the internal accessible axially extending opening 36 of the object 38 to be lifted, shown in phantom. Once attachment is accomplished through the above-discussed probe 16 system/sleeve mechanism 24 assembly, the object 38 can be lifted and reoriented. The drawing shows an electrical control mechanism 48 for initiating the dual arm actuators 42; however, other means would accomplish the same result.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. Apparatus for lifting and reorienting an object having an internal accessible axially extending opening, comprising:

(a) a frame;

(b) a probe pivotably carried by said frame and having at least one projection disposed for radial reciprocation relative thereto between a retracted position and an extended position;

(c) a sleeve assembly, having an outer surface substantially conforming to the object opening, encircling said probe and disposed for relative axial movement thereto between first and second positions, said sleeve assembly having an access port to permit passage of said projection therethrough;

(d) means urging said projections into its extended position when said sleeve assembly is in said first position, and for urging said projection into its retracted position when said sleeve assembly is in said second position; and (e) means, coaxial with said probe and said sleeve assembly, for biasing said sleeve assembly to said first position.

2. The apparatus defined in claim 1, wherein the means for biasing said sleeve assembly to said first position comprises a spring mechanism encircling said probe for exerting pressure generally equally about an end of the sleeve assembly nearer to the frame.

3. The apparatus as defined in claim 1, wherein the means for urging said projection into its retracted position comprises a recess formed within said sleeve and located therein relative to the retractable projection, a wall of which recess abuts the retractable projection and urges the projection to retract upon axial movement of the sleeve assembly to second position.

4. The apparatus as defined in claim 1 further comprising a radially extending appendage rigidly affixed to said probe wherein said appendage interacts with said sleeve assembly to limit relative axial motion therebetween.

5. The apparatus defined in claim 4 wherein said sleeve assembly has an elongated, axially extending slot to receive the radially extending appendage.

6. The apparatus as defined in claim 1 wherein said probe further comprises pivoting means including a dual arm actuator.

7. An apparatus for lifting and reorienting an object having an internal accessible axially extending opening, comprising:

(a) a frame;

(b) a probe pivotably carried by said frame and having at least one projection disposed for radial reciprocation relative thereto between a retracted position and an extended position;

(c) a sleeve assembly encircling said probe and disposed for relative axial movement between a first and second position, said sleeve assembly having an access port to permit passage of said projection therethrough when in said first position;

(d) spring biasing means, coaxial with said probe, for biasing said sleeve assembly to said first position; and (e) probe pivoting means further comprising a dual arm actuator.

8. Apparatus for lifting and reorienting an object having an internal axially extending opening, comprising:

(a) a frame;

(b) a probe pivotally carried by said frame for attachment to objects to be lifted and reoriented by insertion in the internal axially extending opening, said probe including at least one projection disposed for radial reciprocation relative thereto;

(c) a dual arm actuator pivotably carried by said frame and providing means for pivoting said probe;

(d) a sleeve assembly for governing radial reciprocation of said at least one projection relative to said probe, said sleeve assembly encircling said probe and being disposed for axial movement relative thereto, said sleeve assembly having an access port formed therein to permit passage of said radially reciprocating projection therethrough when said sleeve assembly is disposed relative to said probe such that said access port is in registration with said radially reciprocating projection; and (e) means, coaxial with said probe, for biasing said sleeve assembly to an axial position relative to said probe wherein said access port is in registration with said radially reciprocating projection to permit said projection to extend radially from said probe.

9. The apparatus as defined in claim 8 wherein said probe further comprises means for limiting movement of said sleeve assembly including a radially extended appendage rigidly affixed to said probe.

10. The apparatus as defined in claim 9 wherein said sleeve assembly has formed therein an elongated slit to receive said appendage and limit axial movement of said radially extended appendage.

11. The apparatus as defined in claim 8 further comprising a linkage arm for linking said dual arm actuator and said probe.

12. The apparatus as defined in claim 11 wherein said linkage arm pivotably attaches to said dual arm actuator and rigidly attaches to said probe, and further comprises means for translating motion of said dual arm actuator to said probe.

13. The apparatus as defined in claim 12 wherein said dual arm actuator employs a pair of coordinated arms, and wherein said actuator, through one of extension and retraction of said arms, translates motion of said dual arm actuator through the linkage arm to effectuate movement of said probe.

* * * * *